US005437177A

United States Patent [19]

Orcutt et al.

[11] Patent Number: 5,437,177

[45] Date of Patent: Aug. 1, 1995

[54] PORTABLE COLLET CRIMPING APPARATUS

[75] Inventors: Eric D. Orcutt, Rockvale, Tenn.; George Easterday, Jr.; Duane L. Lambert, both of Columbia City, Ind.; Marlin D. Meredith, North Webster, Ind.

[73] Assignee: Dana Corporation, Toledo, Ohio

[21] Appl. No.: 217,614

[22] Filed: Mar. 25, 1994

Related U.S. Application Data

[62] Division of Ser. No. 947,494, Sep. 18, 1992, Pat. No. 5,297,417.

[51] Int. Cl.[6] ..... B21D 41/04

[52] U.S. Cl. ..... 72/402; 72/453.16

[58] Field of Search ..... 72/402, 453.01, 453.16; 29/237

[56] References Cited

U.S. PATENT DOCUMENTS

| | | | |
|---|---|---|---|
| D. 288,327 | 2/1987 | Proctor et al. | D15/123 |
| 2,978,263 | 4/1961 | Walsh et al. . | |
| 3,011,750 | 12/1961 | Johnson | 72/453.16 |
| 3,422,750 | 1/1969 | Anderson | 100/231 |
| 3,750,453 | 8/1973 | Dryden | 72/402 |
| 3,822,456 | 7/1974 | Petruzzi | 72/402 |
| 3,851,514 | 12/1974 | Chen et al. | 72/402 |
| 4,014,202 | 3/1977 | Van Allen | 72/402 |
| 4,050,286 | 9/1977 | Gasier | 72/402 |
| 4,244,091 | 1/1981 | Kimble | 72/402 |
| 4,285,228 | 8/1981 | Gunning | 72/402 |
| 4,509,357 | 4/1985 | Zbornik | 72/389 |
| 4,703,643 | 11/1987 | Brooks | 72/402 |
| 4,773,249 | 9/1988 | Hoff et al. | 72/402 |
| 4,781,055 | 11/1988 | Phipps | 72/402 |
| 4,854,031 | 8/1989 | Elsenzimmer | 29/508 |
| 4,866,973 | 9/1989 | Hoff | 72/402 |
| 5,044,190 | 9/1991 | Hoff et al. | 72/402 |

FOREIGN PATENT DOCUMENTS

| | | | |
|---|---|---|---|
| 396991 | 11/1990 | European Pat. Off. | 72/442 |
| 2146569 | 4/1985 | United Kingdom | 72/444 |
| 1382574 | 3/1988 | U.S.S.R. | 72/446 |

*Primary Examiner*—Daniel C. Crane

*Attorney, Agent, or Firm*—MacMillan, Sobanski & Todd

[57] ABSTRACT

A portable, self-contained collet crimping apparatus includes a base having a hand-actuated hydraulic pump assembly mounted thereon is disclosed. A collet crimping machine is pivotably mounted on the base so as to be adjustably oriented at any desired angle. Means are provided for selectively retaining the collet crimping machine in a desired rotational position relative to the base. The hydraulic pump assembly is connected to actuate the collet crimping machine. The collet crimping machine further includes a pusher which secured to the machine to prevent loss, yet which is slidable between extended and retracted positions. In the extended position, the pusher is disposed outwardly away from the collet crimping machine to permit easy replacement of a die assembly. In the retracted position, the pusher is disposed within the collet crimping machine and precisely aligned with the other components thereof for use. A handle may be secured to the pusher to provide a convenient grasping location for an operator to effect sliding movement thereof. Means are provided for positively retaining the pusher in the retracted position for use.

15 Claims, 5 Drawing Sheets

PORTABLE COLLET CRIMPING APPARATUS

This is a divisional of application Ser. No. 07/947,494 filed on Sep. 18, 1992; now U.S. Pat. No. 5,297,417.

BACKGROUND OF THE INVENTION

This invention relates in general to devices for crimping fittings onto the ends of hoses and in particular to a self-contained, portable collet crimping apparatus.

The collet crimping machine is a well known device which is adapted to secure a cylindrical end portion of a metallic fitting onto an end of a high pressure hydraulic hose. Initially, the end portion of the fitting is formed having an inner diameter which is slightly larger than the outer diameter of the hose, permitting the end of the hose to be loosely inserted therein. Then, the end of the hose and the fitting are inserted within the collet crimping machine. When the collet crimping machine is actuated, the fitting is crimped so as to permanently deform the tubular end portion thereof about the end of the hose.

To accomplish this, a typical collet crimping machine is provided with a hydraulic actuator which is adapted to engage a contractable die assembly. The hydraulic actuator includes a cylinder having a piston slidably disposed therein. When pressurized hydraulic fluid is supplied to the interior of the cylinder, the piston is moved from a first position to a second position. The die assembly typically includes a die ring having a tapered inner surface and a plurality of collet segments disposed within the die ring. A spacer or pusher is disposed between the piston of the hydraulic actuator and the collet segments. Thus, when the piston is moved to the second position, the pusher is moved to engage and move the collet segments. Because of their engagement with the tapered inner surface of the die ring, the collet segments are contracted inwardly toward one another, thereby crimping the fitting disposed therein about the hose.

Typically, the die assembly is removable from the collet crimping machine. This is done to permit the installation and removal of collet segments of different sizes, which permit the collet crimping machine to crimp fittings of various sizes onto hoses of various sizes. To facilitate the installation and removal of the collet segments, it is known to provide a pusher which is removable from the collet crimping machine. Such removable pushers provide convenient access to the die assembly when changing the collet segments. However, when these pusher are re-installed in the collet crimping machine, they must be carefully aligned between the piston and the die assembly in order to function properly. This careful re-alignment has been found to be undesirably time consuming after each change of the collet segments. Also, although removable pushers are typically retained to the collet crimping machine in some manner, such as by a chain, they have occasionally become separated therefrom and lost. Accordingly, it would be desirable to provide a collet crimping machine wherein the pusher is secured thereto, yet which is movable between extended and retracted positions to facilitate changing of the collet segments.

As mentioned above, the collet crimping machine typically includes a hydraulic actuator which is operated by the application of pressurized hydraulic fluid thereto. In a manufacturing situation, the collet crimping machine can be connected to any conventional external source of pressurized fluid which is commonly available in the manufacturing environment. However, often it is necessary to repair fittings and hoses in the field, where a source of pressurized fluid is not readily available. Accordingly, it would also be desirable to provide a collet crimping machine having a self-contained source of pressurized hydraulic fluid, thereby facilitating the use thereof in the field.

SUMMARY OF THE INVENTION

This invention relates to an improved structure for a collet crimping apparatus which is self-contained and easily portable for use in the field. The apparatus includes a base having a hand-actuated hydraulic pump assembly mounted thereon. A collet crimping machine is pivotably mounted on the base so as to be adjustably oriented at any desired angle. Means are provided for selectively retaining the collet crimping machine in a desired rotational position relative to the base. The hydraulic pump assembly is connected to actuate the collet crimping machine. Thus, the collet crimping machine has a self-contained source of pressurized hydraulic fluid, thereby facilitating the use thereof in the field where a source of pressurized fluid may not be readily available.

The collet crimping machine further includes a pusher which secured to the machine to prevent loss, yet which is slidable between extended and retracted positions. In the extended position, the pusher is disposed outwardly away from the collet crimping machine to permit easy replacement of a die assembly. In the retracted position, the pusher is disposed within the collet crimping machine and precisely aligned with the other components thereof for use. The pusher may have an outwardly extending handle connected thereto to provide a convenient grasping location for an operator to effect sliding movement of the pusher. Means are provided for positively retaining the pusher in the retracted position for use.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
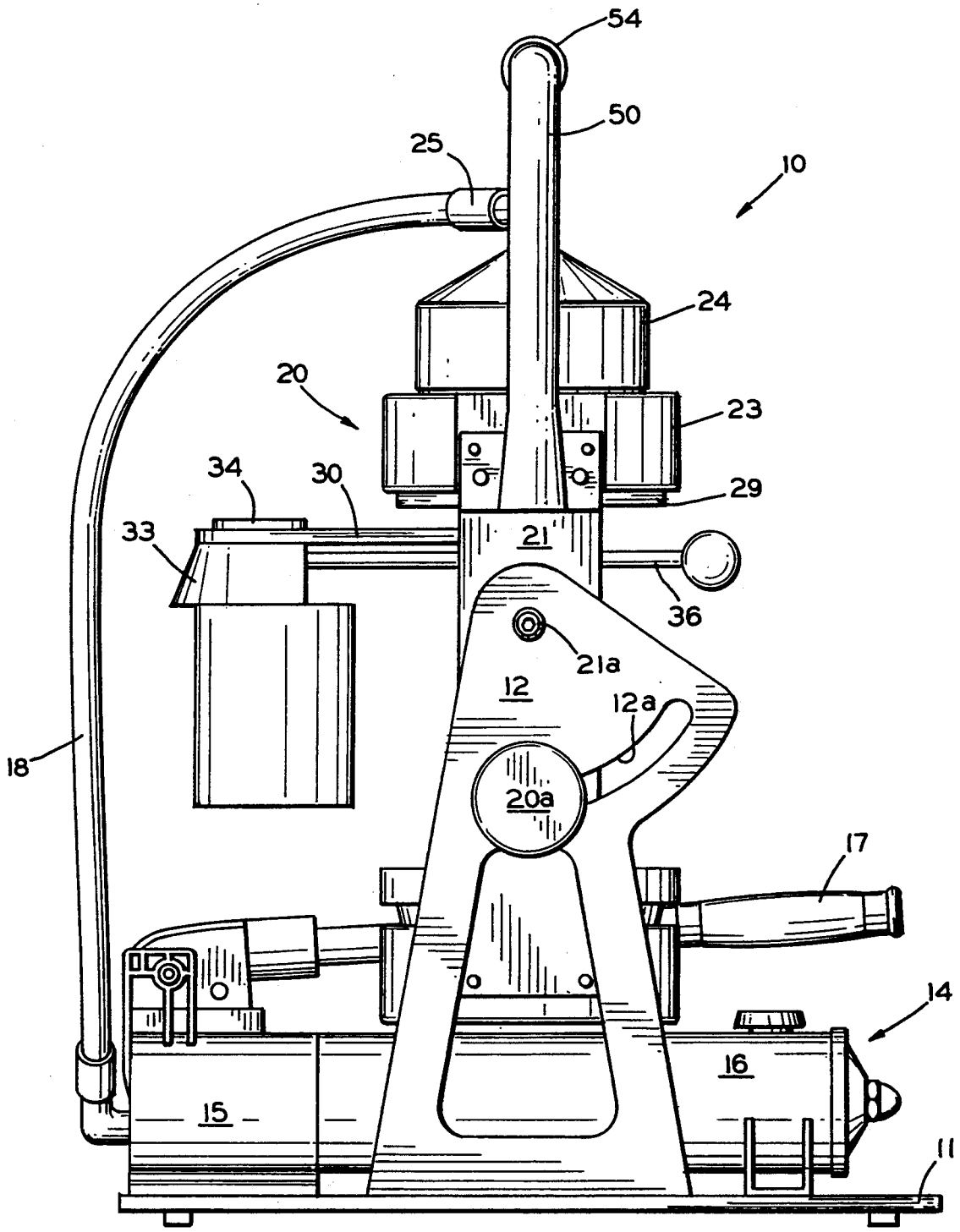
FIG. 1 is an elevational view of the left side of a portable collet crimping machine in accordance with this invention, wherein the pusher of the machine is shown in an extended position.

Referring now to the drawings, there is illustrated a portable collet crimping assembly, indicated generally at 10, in accordance with this invention. The collet crimping assembly 10 includes a base plate 11 having upstanding left and right support brackets 12 and 13 secured thereto, such as by welding. The left bracket 12 has an arcuate slot 12*a* formed therein for a purpose which will be explained below. A hydraulic pump assembly, indicated generally at 14, is also mounted on the base plate 11. The pump assembly 14 includes a fluid reservoir 15, a cylinder 16 containing a movable piston (not shown), and a pivotable handle actuator 17. In operation, an operator may grasp and pivot the handle actuator 17 relative to the pump assembly 14 to cause movement of the piston within the cylinder 16, thereby creating a flow of pressurized fluid from the fluid reservoir 15 to a flexible output conduit 18. The purpose for generating this flow of pressurized fluid will be explained below.

The collet crimping assembly 10 further includes a collet crimping machine, indicated generally at 20, which is pivotably mounted on the support brackets 12 and 13. The collet crimping machine 20 includes left and right side brackets 21 and 22 which are pivotably connected to the left and right support plates 12 and 13, respectively, by pivot pins 21*a* and 22*a*. Thus, the collet crimping machine 20 is supported on the support brackets 21 and 22 for rotation about an axis which extends though the aligned pivot pins 21*a* and 22*a*. This axis of rotation is preferably co-axially aligned with the center of gravity of the collet crimping machine 20. Thus, the collet crimping machine 20 pivots easily about the axis of rotation.

Means are provided for selectively retaining the collet crimping machine in a desired rotational position relative to the base plate 11. In the illustrated embodiment, this means for selectively retaining includes a knob 20*a* having a threaded shank (not shown) extending outwardly therefrom. The threaded shank of the knob 20*a* extends through the arcuate slot 12*a* formed in the left support plate into threaded engagement with a correspondingly threaded aperture (not shown) formed in the left side bracket 21. When tightened, the knob 20*a* causes the left support plate 12 to frictionally engage the left side bracket 21. As a result, the collet crimping machine 20 is prevented from rotating relative to the base plate 11. Upon loosening of the knob 20*a*, the collet crimping machine 20 may be rotated to a desired angular disposition relative to the base plate 11. The limits of such relative rotation are defined by the extent of the arcuate slot 12*a*, inasmuch as the threaded shank of the knob 20*a* extends therethrough.

Figure 5:
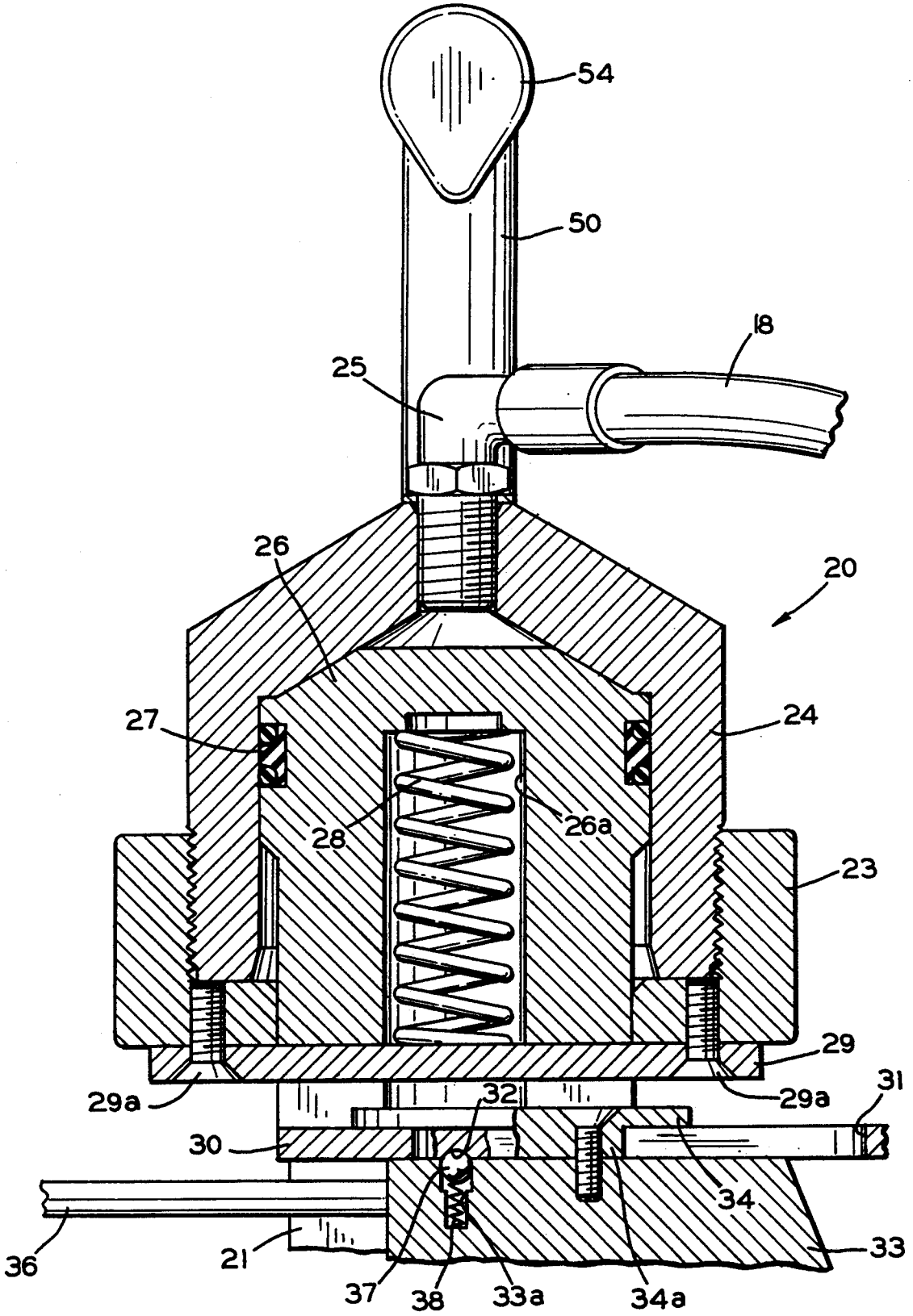
FIG. 5 is an enlarged side elevational view, partially in cross section, of the upper portion of the portable collet crimping machine shown in FIG. 2.

The upper ends of the side brackets 21 and 22 are connected to the opposed sides of a cylinder ring 23, such as by welding. As best shown in FIG. 5, the inner surface of the cylinder ring 23 is formed having an internal thread. This internally threaded surface of the cylinder ring 23 is cooperates with a lower externally threaded outer surface of a cylinder housing 24. A hydraulic fitting 25 is threaded into an aperture formed through the upper portion of the cylinder housing 24. The fitting 25 provides for fluid communication between the flexible conduit 18 of the pump assembly 14 and the interior of the cylinder housing 24. Thus, when the pump assembly 14 is actuated by movement of the handle actuator 17, pressurized hydraulic fluid is introduced into the upper end of the cylinder housing 24.

A piston 26 is disposed within the interior of the cylinder housing 24 for sliding movement. A conventional seal assembly 27 is provided in an outer circumferential groove formed in the piston 26. The seal assembly 27 provides a relatively fluid tight seal between the piston 26 and the inner surface of the cylinder housing 24, while permitting relative movement. When pressurized hydraulic fluid is introduced into the interior of the cylinder housing 24 as described above, the piston 26 is urged downwardly within the cylinder housing 24. A return spring 28 is provided for urging the piston 26 upwardly within the cylinder housing 24 when the pressurized fluid is removed therefrom. The return spring 28 is disposed within a counterbore 26*a* formed in the piston 26. The return spring 28 reacts against a retainer plate 29 which is secured to the lower end of the cylinder ring 23 by a plurality of threaded fasteners 29*a*.

A slide plate 30 is secured to the lower end of the piston 26 by a plurality of threaded fasteners (not shown). Thus, the slide plate 30 moves upwardly and downwardly with the piston 26 as described above. The slide plate 30 has an elongated slot 31 formed therethrough. Also, the slide plate 30 has a generally semi-spherical recess 32 formed in the lower surface thereof, adjacent to the slot 31. A pusher 33 is supported beneath the slide plate 30 for upward and downward movement therewith. To accomplish this, a slide flange 34 is disposed above the slide plate 30. The slide flange 34 includes an upper portion which is disposed adjacent (and is adapted to slide along) the upper surface of the slide plate 30. The slide flange 34 further includes a depending portion 34*a* which extends into the elongated slot 31 of the slide plate 30. The pusher 33 is connected to the slide flange 34 by one or more threaded fasteners 35, which also extend through the slot 31.

The slide plate 30 is only loosely engaged between the upper portion of the pusher 33 and the lower surface of the slide flange 34. Thus, the pusher 33, the slide flange 34, and the threaded fasteners 35 may be moved as a unit laterally relative to the slide plate 30 and the remainder of the collet crimping apparatus 10. The depending portion 34*a* of the slide flange 34 is provided to guide the slide flange 34 (and the pusher 33 secured thereto) for sliding movement along the slide plate 30. The limits of such lateral movement are defined by the engagement of such depending portion 34*a* with the ends of the elongated slot 30*a* formed through the slide plate 30.

Figure 2:
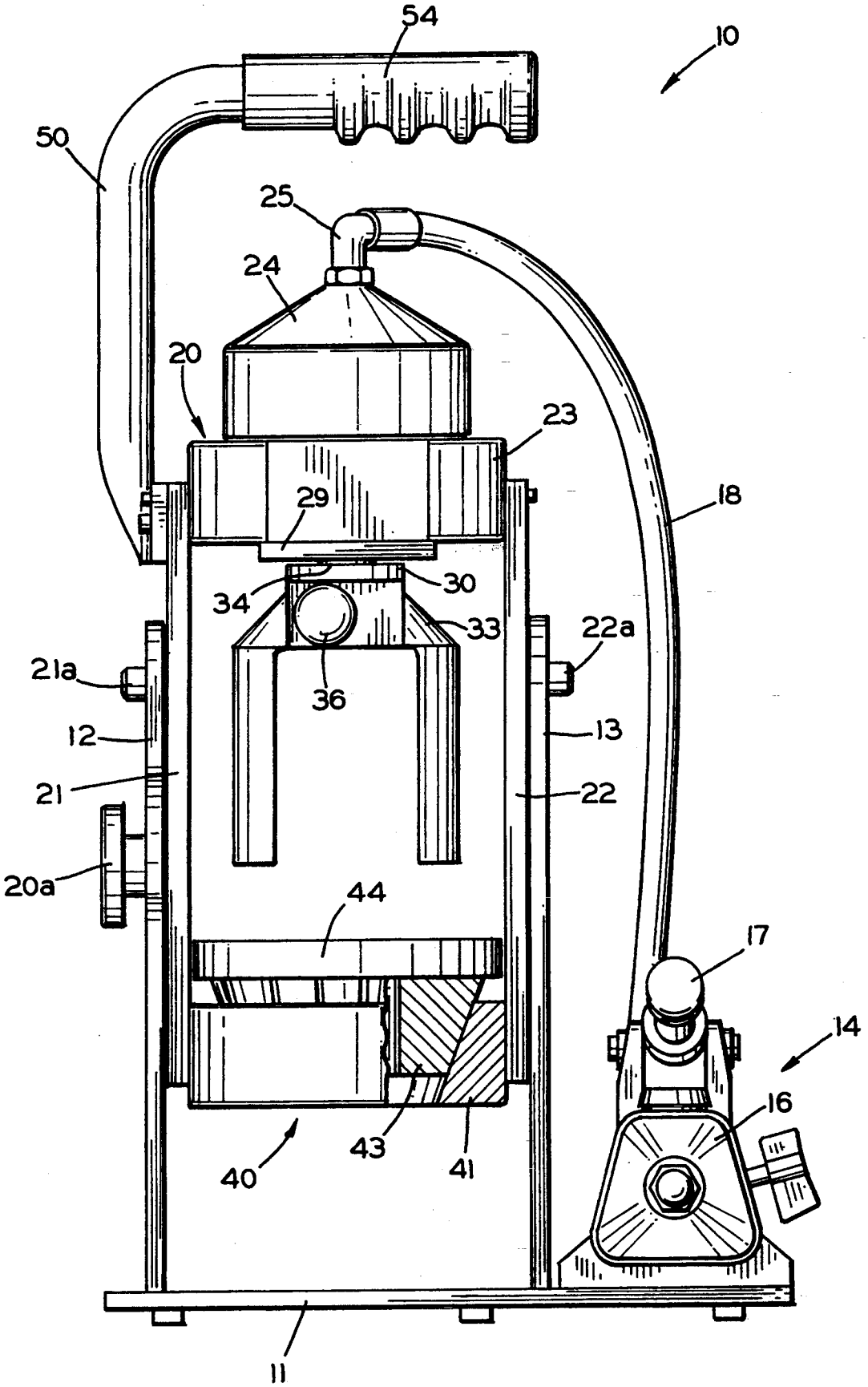
FIG. 2 is an elevational view, partially broken away, of the front side of the portable collet crimping machine shown in FIG. 1, wherein the pusher of the machine is shown in an extended position.
Figure 3:
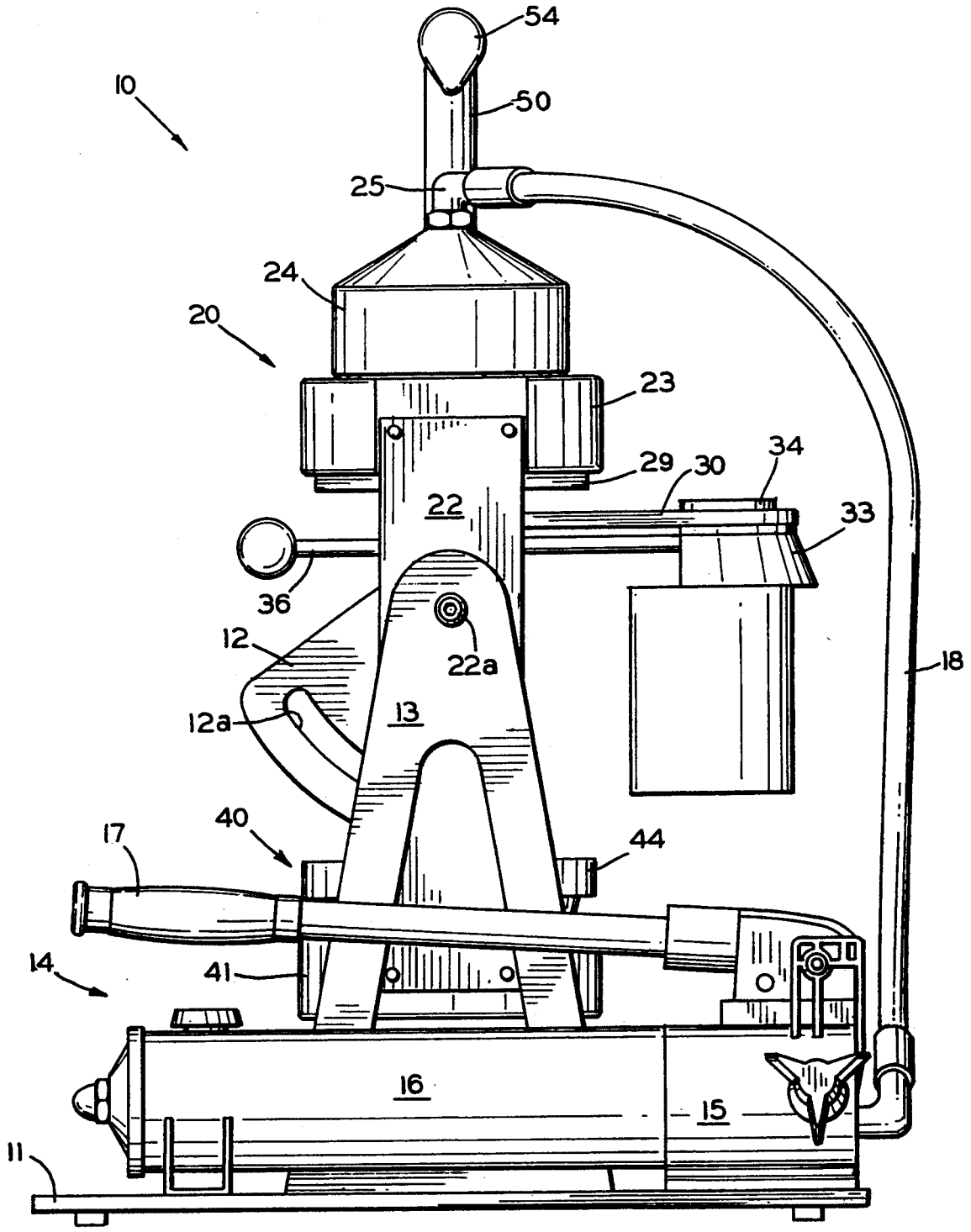
FIG. 3 is an elevational view of the right side of the portable collet crimping machine shown in FIG. 1, wherein the pusher of the machine is shown in an extended position.
Figure 4:
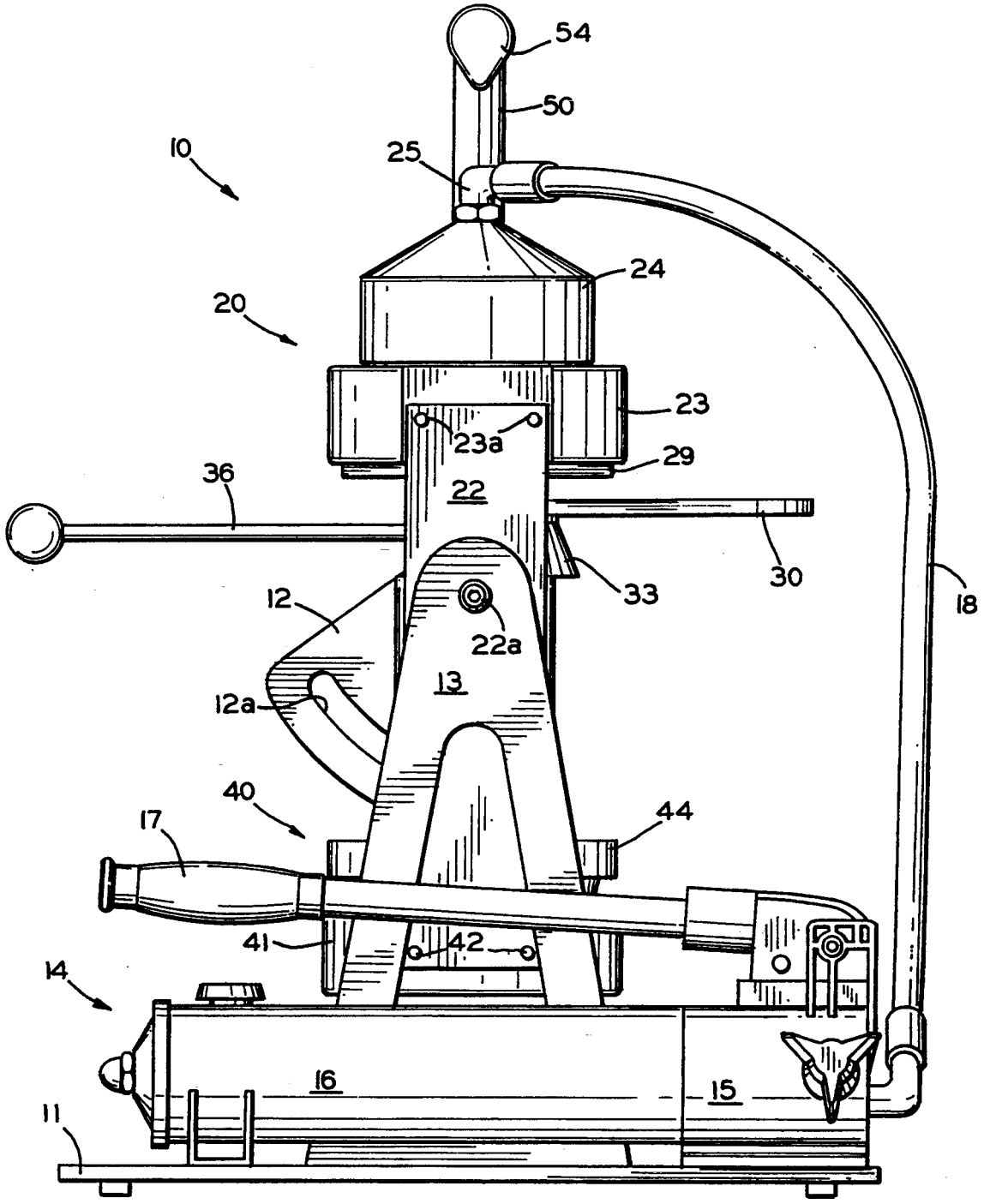
FIG. 4 is a side elevational view from the right of the portable collet crimping machine similar to FIG. 3, wherein the pusher of the machine is shown in a retracted position.

Thus, the pusher 33 may be moved between an extended position (illustrated in FIGS. 1 through 3) and a retracted position (illustrated in FIGS. 4 and 5). In the extended position, the pusher 33 is disposed outwardly away from the piston 26. In the retracted position, the pusher 33 is disposed directly beneath the piston 26. A handle 36 is connected to the pusher 33 for movement therewith. The handle 36 extends laterally outwardly from the collet crimping machine 20 and provides a convenient grasping location for an operator to effect sliding movement of the pusher 33. The purpose for mounting the pusher 33 on the collet crimping machine 20 in this manner will be explained below.

Means are provided for positively retaining the pusher 33 in the retracted position. In the illustrated embodiment, such means includes a stepped counterbore 33*a* formed in the upper surface of the pusher 33.

A ball 37 and a spring 38 are disposed within the counterbore 33*a*. The spring 38 urges the ball 37 upwardly against the lower surface of the slide plate 30. When the pusher 33 is disposed in the retracted position, the ball 37 is urged by the spring 38 into the semi-spherical recess 32 formed in the lower surface of the slide plate 30. Thus, the pusher 33 is positively retained in the retracted position. Also, when the pusher 33 is moved from the extended position to the retracted position, the ball 37 snaps into engagement with the recess 32. This engagement provides a tactile indication to the operator that the pusher 33 is properly positioned for engagement by the piston 26, as will be explained below.

The collet crimping machine 20 further includes a die assembly, indicated generally at 40. The die assembly 40 includes a die ring 41 which is secured to the lower ends of the left and right support brackets 21 and 22, such as by welding. The inner surface of the die ring 41 is tapered, as shown at 41*a* in FIG. 2. A plurality of collet segments 43 are disposed in an annular array within the tapered inner surface 41*a* of the die ring 41. The die assembly 40 further includes a spacer ring 44 which is disposed above the collet segments 43. The spacer ring 44 is sized to be engaged by the lower end of the pusher 33 when the pump assembly 14 is actuated to move the piston 26, as described above.

As is known in the art, the die assembly 40 is provided to crimp a fitting onto the end of a hose. To accomplish this, the hose having the fitting loosely carried thereon is inserted within the collet segments 43 of the die assembly 40. Then, the pump assembly 14 is actuated by movement of the handle actuator 17 so as to cause the piston 26 and the pusher 33 to moved downwardly into engagement with the die assembly 40. Because of the cooperation of the collet segments 43 with the tapered inner surface 41*a* of the die ring 41, the fitting is crimped onto the end of the hose.

As described above, the collet crimping apparatus 10 is preferably adaptable for use in crimping fittings of various sizes onto hoses of various sizes. To accommodate these different sizes, a plurality of differently sized groups of collet segments 43 are provided for use with the die ring 41 and the spacer ring 44 of the die assembly 40. These differently sized collet segments 43 permit the collet crimping machine 20 to be used with a number of differently sized fittings and hoses. Thus, it is important that the collet segments 43 and the spacer ring 44 be easily removable from the collet crimping machine 20 to facilitate change from size to size.

The slidable pusher 33 of this invention facilitates this changing of the collet segments 43. As described above, when in the extended position, the pusher 33 is disposed outwardly away from the piston 26. As a result, easy access is provided to the collet segments 43 and the spacer ring 44. Thus, the set of collet segments 43 can quickly be removed and replaced with another set of collet segments of different size. When in the retracted position, the pusher 33 is disposed directly beneath the piston 26 for use in the crimping operation. Throughout this entire process, the pusher 33 remains secured to the collet crimping machine 20, thereby preventing the accidental loss thereof.

Because the pump assembly 14, the fluid reservoir 15, and the crimping machine 20 are all mounted on the base plate 11, it will be appreciated that the collet crimping apparatus 10 is a totally self-contained unit which is readily portable and easily adapted for use in the field. A generally L-shaped carrying handle 50 is provided for moving the collet crimping assembly 10 from location to location. The handle 50 is secured to a mounting plate 51, such as by welding. The mounting plate 51 is secured to the upper end of the left side bracket 21 of the collet crimping machine 20, such as by welding.

If desired, a conventional grip 54 may be mounted on the end of the handle 50. The grip 54 of the handle 50 is preferably located directly above the center of gravity of the collet crimping apparatus 10. As mentioned above, the collet crimping machine 20 is supported on the support brackets 21 and 22 for rotation about an axis which is preferably co-axially aligned with the center of gravity of the collet crimping machine 20. Thus, regardles of the angular orientation of the collet crimping machine 20, the handle 50 can be grasped to conveniently pick up and move the entire collet crimping apparatus 10 from location to location.

In operation, the portable collet crimping apparatus 10 can be transported to a desired location by means of the carrying handle 50. Once properly located, the angular disposition of the collet crimping machine 20 can be adjusted relative to the base plate 11 by loosening the knob 20*a*. The collet crimping machine 20 is rotated to a desired angular disposition, then the knob 20*a* is tightened to maintain it in that position. Next, the pusher 33 is moved to the extended position by pushing on the handle 36. As a result, the pusher 33 and the slide flange 34 are moved relative to the slide plate 30 and the remainder of the components of the collet crimping assembly 10.

As described above, access to the collet segments 43 is permitted when the pusher 33 is in the extended position. Thus, while the pusher 33 is in the extended position, the appropriately sized collet segments 34 are inserted within the die ring 41, and the spacer ring 44 is replaced above the collet segments 34. Then, the handle 36 is grasped so as to move the pusher 33 from the extended position to the retracted position. As mentioned above, when the pusher 33 is moved from the extended position to the retracted position, the ball 37 snaps into engagement with the recess 32 to positively retain the pusher 33 therein and to provide a tactile indication to the operator.

In accordance with the provisions of the patent statues, the principle and mode of operation of this invention have been explained and illustrated in its preferred embodiment. However, it must be understood that this invention may be practiced otherwise than as specifically explained and illustrated without departing from its spirit or scope.

What is claimed is:

1. A manually operable, self contained, portable apparatus for crimping a fitting onto the end of a hose comprising:

a base plate;

a collet crimping machine mounted on said base plate, said collet crimping machine including a die assembly adapted to be engaged to crimp a fitting onto the end of a hose, said collet crimping machine further including a hydraulic actuator responsive to pressurized fluid to engage said die assembly, said collet crimping machine mounted on said base plate for pivoting movement relative thereto so that said die assembly and hydraulic actuator can be pivoted relative to said base plate; and a manually operable hydraulic pump assembly mounted on said base plate and connected to said collet crimping machine for selectively actuating said actuator to engage said die assembly, said hydraulic pump assembly including a fluid reservoir, a pump having an inlet connected to said fluid reservoir and an outlet connected to said actuator, a conduit connecting said fluid reservoir and actuator between said inlet and outlet, and a manually operable handle for actuating said pump to supply pressurized fluid to said actuator, said fluid reservoir, pump, and handle being fixedly mounted to said base so that said pivoting of said crimping machine is relative to said fluid reservoir, pump and handle.

2. The apparatus defined in claim 1 wherein said means for selectively actuated for engaging said die assembly includes a cylinder having a piston which is movable between a first position and a second position, a pusher, and means for locating said pusher relative to said piston in a retracted position, wherein said pusher is disposed between said piston and said die assembly such that said piston urges said pusher into engagement with said die assembly to crimp a tubular fitting onto the end of a hose when said piston is moved from said first position to said second position, and an extended position, wherein said pusher is not disposed between said piston and said die assembly.

3. The apparatus defined in claim 2 further including means for connecting said pusher to said piston for movement therewith between said first and second positions while permitting movement relative thereto between said retracted and extended positions.

4. The apparatus defined in claim 3 wherein said means for connecting includes a slide plate secured to said piston and means for slidably supporting said pusher on said slide plate.

5. The appartus defined in claim 4 wherein said means for slidably supporting includes a slot formed through said slide plate and means connected to said pusher and extending through said slot for slidably supporting said pusher on said slide plate.

6. The apparatus defined in claim 5 wherein said means connected to said pusher includes a slide flange disposed on a side of said slide plate opposite said pusher and means extending through said slot for connecting said slide plate to said pusher, said slide flange slidably supporting said pusher on said slide plate.

7. The apparatus defined in claim 6 wherein said means extending through said slot for connecting said slide plate to said pusher includes a threaded fastener.

8. The apparatus defined in claim 6 wherein said slide flange includes a portion which extends into said slot in said slide plate to guide the movement of said pusher between said retracted and extended positions.

9. The apparatus defined in claim 6 wherein said means for locating said pusher includes a handle connected to said pusher and extending outwardly therefrom.

10. The apparatus defined in claim 6 further including means for retaining said pusher in said retracted position.

11. The apparatus defined in claim 10 wherein said means for retaining said pusher in said retracted position includes detent means disposed in said pusher for engaging a recess formed in said slide plate when said pusher is in said retracted position.

12. The apparatus defined in claim 11 wherein said detent means includes a counterbore formed in said pusher containing a ball and a spring, said spring urging said ball outwardly into engagement with said slide plate.

13. The apparatus defined in claim 1 further including a handle including a first end and a second end, said first end being secured to said base plate for facilitating the transport of said apparatus from location to location.

14. The apparatus defined in claim 13 wherein said apparatus defines a center of gravity, and wherein a portion of said second end of said handle is located directly above said center of gravity of said apparatus.

15. The apparatus defined in claim 14 wherein a grip is provided on said second end of said handle, and wherein said grip is located above said collet crimping machine and said center of gravity of said apparatus.

* * * * *

UNITED STATES PATENT AND TRADEMARK OFFICE

CERTIFICATE OF CORRECTION

PATENT NO. : 5,437,177

DATED : August 1, 1995

INVENTOR(S) : Eric D. Orcutt, George Easterday, Jr., and Marlin D. Meredith

It is certified that error appears in the above-identified patent and that said Letters Patent is hereby corrected as shown below:

Column 7, Claim 2, Line 2, change "means for selectively actuated" to -- hydraulic actuator --.

Signed and Sealed this

Thirty-first Day of October 1995

*Attest:*

*Attesting Officer*

Bruce Lehman

BRUCE LEHMAN

*Commissioner of Patents and Trademarks*